US010974096B2

(12) United States Patent
Simmons

(10) Patent No.: US 10,974,096 B2
(45) Date of Patent: Apr. 13, 2021

(54) HAMSTRING EXERCISE DEVICE AND METHOD OF USING SAME

(71) Applicant: Louie Simmons, Columbus, OH (US)

(72) Inventor: Louie Simmons, Columbus, OH (US)

( * ) Notice: Subject to any disclaimer, the term of this patent is extended or adjusted under 35 U.S.C. 154(b) by 18 days.

(21) Appl. No.: 16/169,689

(22) Filed: Oct. 24, 2018

(65) Prior Publication Data

US 2020/0129806 A1 Apr. 30, 2020

(51) Int. Cl.
*A63B 23/04* (2006.01)
*A63B 21/00* (2006.01)

(52) U.S. Cl.
CPC .... *A63B 23/0405* (2013.01); *A63B 21/00076* (2013.01); *A63B 21/4039* (2015.10); *A63B 21/4045* (2015.10); *A63B 2208/0261* (2013.01)

(58) Field of Classification Search
CPC ..... A63B 21/00; A63B 21/00047; A63B 21/00076; A63B 21/40; A63B 21/4027; A63B 21/4039; A63B 21/4041; A63B 21/4045; A63B 23/00; A63B 21/035; A63B 21/04; A63B 21/0405; A63B 2208/00; A63B 2208/02; A63B 2208/0242; A63B 2208/0257; A63B 2208/0261; A63B 21/02; A63B 21/0261; A63B 21/4029–4031; A63B 22/201–208
See application file for complete search history.

(56) References Cited

U.S. PATENT DOCUMENTS 2,783,045 A * 2/1957 Bosch ..... A63B 21/0622 482/96
4,632,390 A * 12/1986 Richey ..... A63B 21/00072 482/133
4,828,255 A * 5/1989 Lahman ..... A63B 21/00047 482/142
5,263,913 A * 11/1993 Boren ..... A63B 21/068 482/132
5,620,403 A * 4/1997 Lundin ..... A63B 21/0552 482/96
5,674,168 A * 10/1997 Wilkinson ..... A63B 22/0023 482/115
5,810,698 A * 9/1998 Hullett ..... A63B 21/068 482/134
7,163,498 B1 * 1/2007 Abelbeck ..... A63B 21/068 482/142

(Continued)

FOREIGN PATENT DOCUMENTS

WO 2015138279 A1 9/2015

OTHER PUBLICATIONS

Google, Adjacent Definition, Jan. 29, 2020 (Year: 2020).*

(Continued)

*Primary Examiner* — Jennifer Robertson
(74) *Attorney, Agent, or Firm* — Michael J. Gallagher; Luper Neidenthal & Logan

(57) ABSTRACT

A hamstring exercise device is provided that allows a user to apply variable resistance to the hamstring muscles during exercise. The hamstring exercise device has a user sled, upon which a user may rest, slidably mounted on an angulation slide. The angulation slide is pivotably adjustable to varying degrees of inclination or declination relative to the horizontal. The user's body weight, resistance of the sled toward moving and an optional biasing means all contribute to an adjustable degree of exercise difficulty.

18 Claims, 3 Drawing Sheets

(56) References Cited

U.S. PATENT DOCUMENTS

| | | | | |
|---|---|---|---|---|
| 8,172,736 | B2 | 5/2012 | Contreras | |
| 2007/0203004 | A1* | 8/2007 | Campanaro | A63B 21/4043 482/142 |
| 2015/0317858 | A1 | 11/2015 | Suetaka et al. | |
| 2015/0367168 | A1* | 12/2015 | Henniger | A63B 23/0222 482/145 |
| 2016/0332024 | A1 | 11/2016 | Ellis | |
| 2017/0246499 | A1 | 8/2017 | Lagree et al. | |
| 2018/0000680 | A1 | 1/2018 | Kelly | |

OTHER PUBLICATIONS

Google, Set for Set Reference Date, Jan. 29, 2020 (Year: 2020).*
Google, Total Gym Reference Date, Jan. 29, 2020 (Year: 2020).*
Set for Set, Strength Training 101: How to use Resistance Bands for Quick Gains, Jul. 7, 2017, https://www.setforset.com/blogs/news/strength-training-101-how-to-use-resistance-bands-for-quick-gains (Year: 2017).*
Total Gym Power Tower, Apr. 30, 2018, https://totalgym.com/products/rs-encompass-power-tower (Year: 2018).*
Total Gym Power Tower Owners Guide, 2019, https://cdn2.hubspot.net/hubfs/4813296/RS_5300_04_EPT_ownersguide_DIGITAL.pdf (Year: 2019).*

* cited by examiner

HAMSTRING EXERCISE DEVICE AND METHOD OF USING SAME

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present disclosure relates to the field of exercise and sports equipment, and more particularly, to a hamstring exercise device, particularly to a device that imparts variable resistance in part depending on body position of a user during exercise.

BACKGROUND OF THE INVENTION

The three muscles of the posterior thigh generally known as the "hamstrings" (semitendinosus, semimembranosus, biceps femoris long & short head) flex, i.e., bend, the knee; while all but the short head of biceps femoris extend (straighten) the hip. The first three "true" hamstrings cross both the hip and the knee joint and are therefore involved in knee flexion and hip extension. The short head of the biceps femoris crosses only one joint (knee) and is therefore not involved in hip extension. With its divergent origin and innervation it is sometimes excluded from the "hamstring" characterization. A portion of the adductor magnus muscle is sometimes considered a part of the hamstrings.

The hamstrings cross and act upon two joints, the hip and the knee, and as such are termed biarticular muscles. The semitendinosus and semimembranosus muscles extend the hip when the trunk is fixed; and they also flex the knee and medially, i.e., inwardly, rotate the lower leg when the knee is bent. The long head of the biceps femoris extends the hip, as when beginning to walk; both short and long heads flex the knee and laterally (outwardly) rotate the lower leg when the knee is bent.

The hamstrings play a crucial role in many daily activities such as walking, running, jumping, and controlling some movement in the trunk. In walking, they are most important as an antagonist to the quadriceps in the deceleration of knee extension.

Because the hamstrings cross the knee and hip joints, they act to bend the knees and draw the hips backwards. The hamstrings contribute to motion, such as walking, and they help an athlete to achieve speed, power and agility in many sports. When executing explosive movement, these muscles play an important part in shifting the load from the knees to the hips. For example, a sprinter's ability to launch off the blocks and accumulate speed depends on strong hamstrings. They also contribute to the ability to absorb the shock of movements involving high velocity or force.

It is well known to those in the art that the exercise and development of the hamstrings is frequently neglected, even by those otherwise dedicated to strength and fitness training. This has been, at least in part, due to the paucity of effective exercise machines that are dedicated to hamstring development. The instant invention, in all of its embodiments, is directed to solving this problem.

SUMMARY OF INVENTION

In its most general configuration, the presently disclosed hamstring exercise device is a device that allows a user to apply variable resistance to the hamstring muscles during exercise.

The hamstring exercise device may have a caudal aspect and a cephalic aspect, defined in detail below. The device includes a base, supporting a user and angulation slide retainer upright at the caudal aspect and an angulation anchor at the cephalic aspect. The angulation slide retainer upright may be coupled to a user and angulation slide retainer, and the angulation retainer upright may be pivotably coupled to a caudal aspect of an angulation slide by an angulation slide anchor retainer anchor pivotably coupled to an angulation slide pivot.

The angulation anchor may be releasably coupled to a cephalic aspect of the angulation slide by an angulation adjustment point releasably coupled to an angulation slide adjustment point. There may be a sled provided, having a body support, that may be slidably engaged to the angulation slide at a sled slide such that the sled is slidably movable between the caudal and the cephalic aspects of the angulation slide.

The angulation adjustment point may be a plurality of angulation adjustment points, and the angulation slide may be pivotably adjustable such as to produce a positive or negative incline, usually but not necessarily a negative incline (declination) relative to the horizontal of the angulation slide, when the angulation slide adjustment point is releasably coupled to at least one of the plurality of angulation adjustment points. The plurality of angulation adjustment points may be, in some embodiments, approximately equally spaced in a superior-inferior aspect along the angulation anchor. The angulation slide may be pivotably adjustable between any two adjoining angulation adjustment points such as to produce a positive or negative incline, usually but not necessarily, a negative incline (declination) of the angulation slide, increasing by approximately 6.5 degrees relative to the horizontal when the angulation slide adjustment point is moved from a superior angulation adjustment point to an adjacent inferior angulation adjustment point.

Further, in other embodiments, the base may have at least one base band peg and the sled may have at least one sled band peg, which may be releasably connectable by at least one biasing means that increases the difficulty of moving the sled from the cephalic aspect to the caudal aspect of the angulation slide. This allows a user to increase his or her strength by exercising against resistance greater than that which would be supplied by the resistance of the sled and the user's body weight alone. One skilled in the art would visualize a large number of potential biasing means, but by way of example only and not limitation, biasing means including elastic bands and springs are specifically envisioned.

Other embodiments may include those where the angulation slide has at least one angulation slide handle at the cephalic aspect of the angulation slide, and those wherein the user and angulation slide retainer has a user and angulation slide retainer base plate releasably engageable with the feet of a user during operation of the device. Furthermore, the sled may be provided with at least one user sled handle grippable by a user during operation of the device.

BRIEF DESCRIPTION OF THE DRAWINGS

Without limiting the scope of the hamstring exercise device as claimed below and referring now to the drawings and figures:

Figure 1:
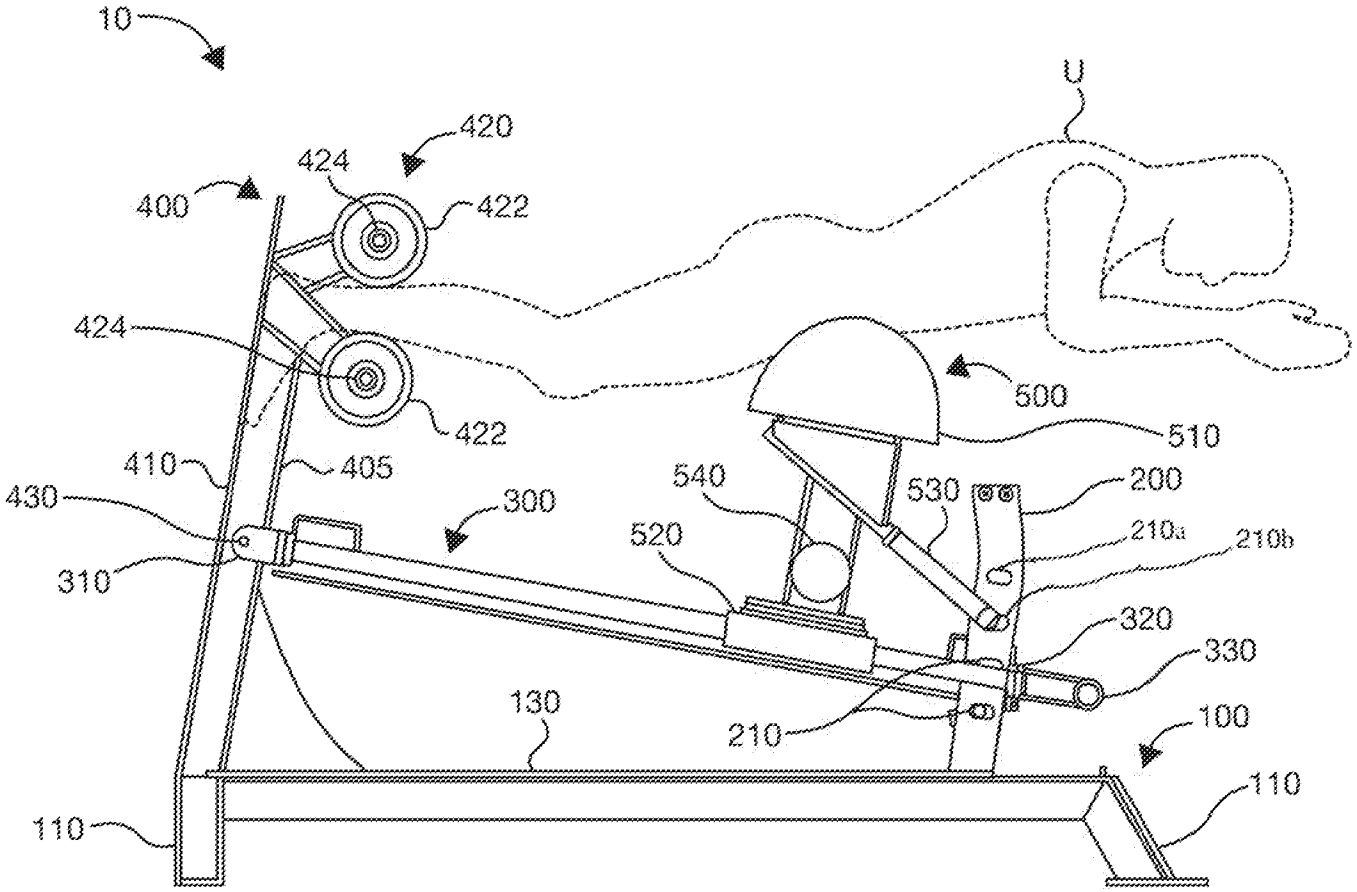
FIG. 1 is a side view of an of an embodiment of the present invention.

These drawings are provided to assist in the understanding of the exemplary embodiments of the presently disclosed hamstring exercise device as described in more detail below and should not be construed as unduly limiting the hamstring exercise device. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

Figure 2:
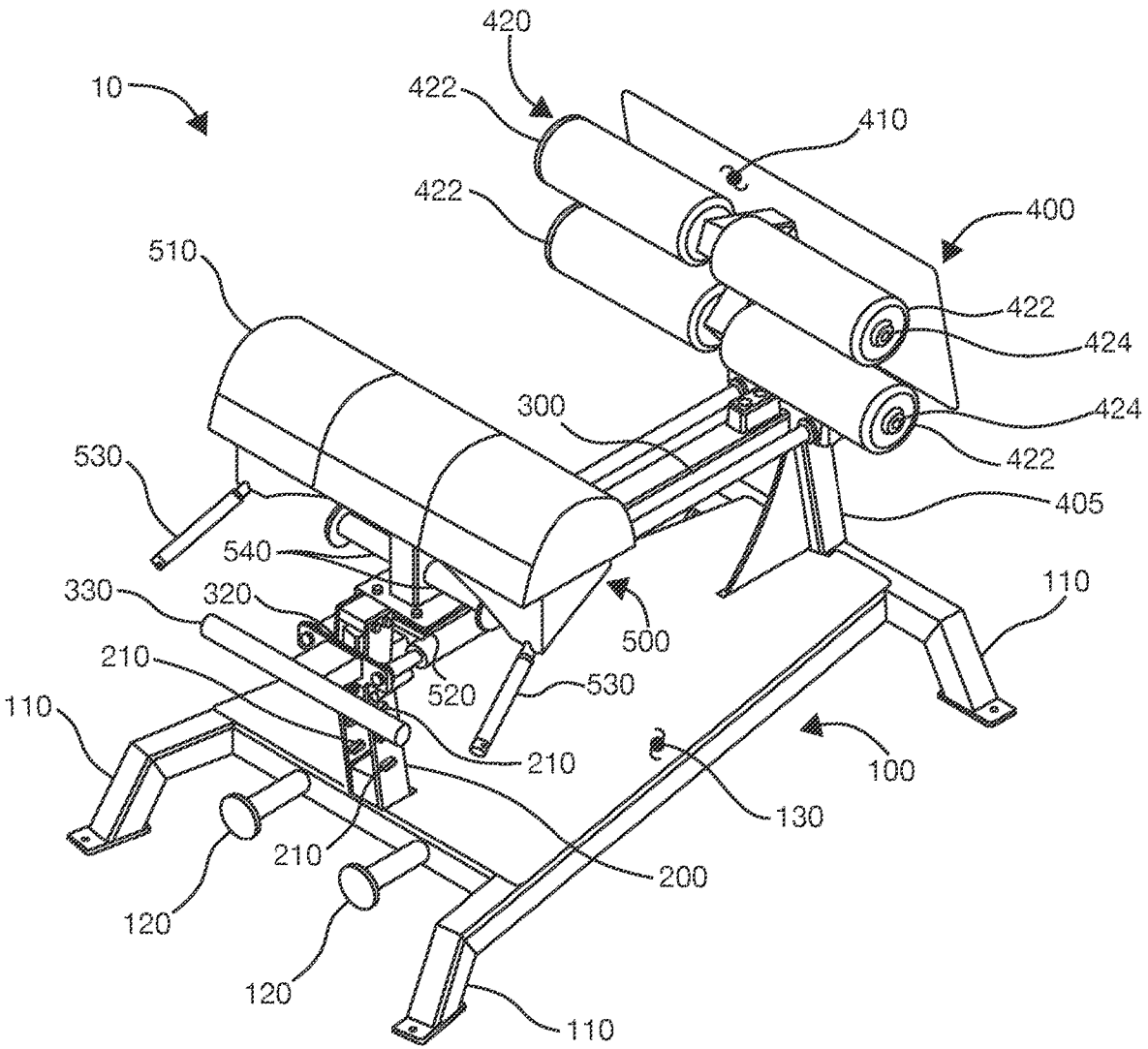
FIG. 2 is an elevated perspective view or the embodiment of FIG. 1.
Figure 3:
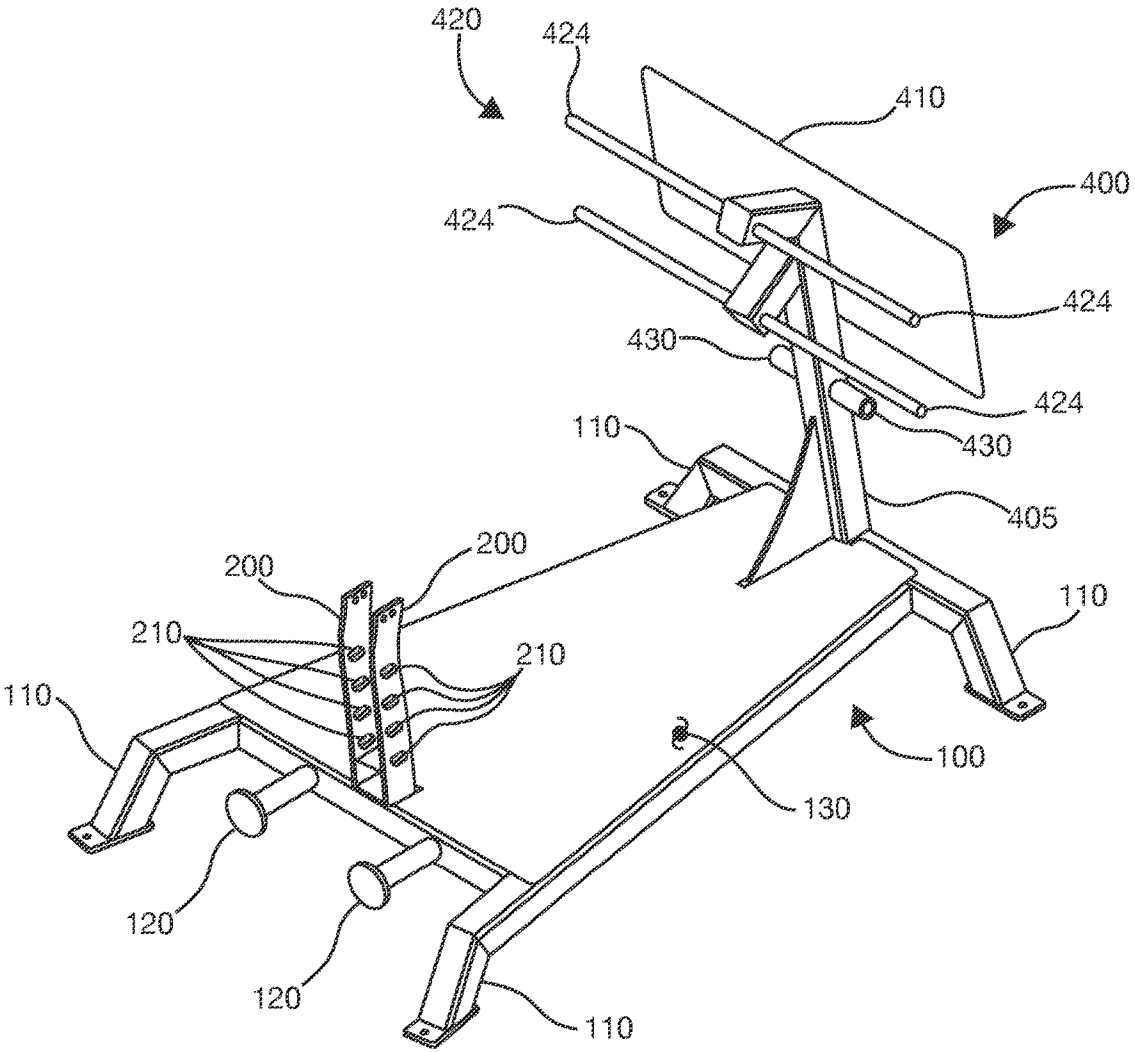
FIG. 3 is an elevated perspective view of a partially disassembled device according to the embodiment of FIGS. 1 and 2.

A hamstring exercise device (10) is seen well in FIGS. 1-3. The preferred embodiments of the device accomplish this by new and novel arrangements of elements and methods that are configured in unique and novel ways and which demonstrate previously unavailable but preferred and desirable capabilities. The detailed description set forth below in connection with the drawings is intended merely as a description of the presently preferred embodiments of the hamstring exercise device (10), and is not intended to represent the only form in which the hamstring exercise device (10) may be constructed or utilized. The description sets forth the designs, functions, means, and methods of utilizing the hamstring exercise device (10) in connection with the illustrated embodiments. It is to be understood, however, that the same or equivalent functions and features may be accomplished by different embodiments that are also intended to be encompassed within the spirit and scope of the hamstring exercise device (10).

Numerous alterations, modifications, and variations of the preferred embodiments disclosed herein will be apparent to those skilled in the art and they are all anticipated and contemplated to be within the spirit and scope of the hamstring exercise device (10). For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only a few variations of the hamstring exercise device (10) are described herein, it is to be understood that the practice of such additional modifications and variations and the equivalents thereof, are within the spirit and scope of the invention.

What is claimed then, as seen well in FIGS. 1-3, includes a hamstring exercise device (10) having a having a caudal aspect and a cephalic aspect. For the purposes of this specification, the term "caudal" shall mean those parts of any structure which are nearer the feet than the head of a user during operation of the device; and the term "cephalic" shall mean those parts of any structure which are nearer the head than the feet of a user during operation of the device. An outline of a generic user, who is otherwise not part of the claimed invention, is shown in dotted lines in FIG. 1 to help the reader in orientation.

The device (10) then, includes a base (100), seen well in FIGS. 1 and 2, supporting a user and angulation slide retainer upright (405) at the caudal aspect and an angulation anchor (200) at the cephalic aspect. The angulation slide retainer upright (405) may be coupled to a user and angulation slide retainer (400), and the angulation retainer upright (405) may be pivotably coupled to a caudal aspect of an angulation slide (300) by a angulation slide anchor retainer anchor (430) pivotably coupled to a angulation slide pivot (310). It is noted that FIGS. 1 and 2 show an embodiment of the assembled device, while FIG. 3 shows a partially disassembled device (10), showing only those elements forming a part of a base (100), an angulation anchor (200), and a user and angulation slide retainer (400).

Again with reference to FIGS. 1 and 2, the angulation anchor (200) may be releasably coupled to a cephalic aspect of the angulation slide (300) by a angulation adjustment point (210) releasably coupled to a angulation slide adjustment point (320). There may be a sled (500) provided, having a body support (510), that may be slidably engaged to the angulation slide (300) at a sled slide (520) such that the sled (500) is slidably movable between the caudal and the cephalic aspects of the angulation slide (300).

As seen well in FIGS. 1 and 3, in some embodiments, the angulation adjustment point (210) may be a plurality of angulation adjustment points (210), and the angulation slide (300) may be pivotably adjustable such as to produce a positive or negative incline, usually but not necessarily, a negative incline (declination) relative to the horizontal of the angulation slide (300), when the angulation slide adjustment point (320) is releasably coupled to at least one of the angulation adjustment points (210). A possible declination can be envisioned well from FIG. 2.

As further seen well in FIGS. 1 and 3, the plurality of angulation adjustment points (210) may be, in some embodiments, approximately equally spaced in a superior-inferior aspect along the angulation anchor (200). The angulation slide (300) may be pivotably adjustable between any two adjoining angulation adjustment points (210) such as to produce a positive or negative incline, usually but not necessarily a negative incline (declination) of the angulation slide (300) increasing by approximately 6.5 degrees relative to the horizontal when the angulation slide adjustment point (320) is moved from a superior angulation adjustment point (210) to an adjacent inferior angulation adjustment point (210).

In various embodiments that would be known to one skilled in the art, the base (100) may have at least one base leg (110). Further, in other embodiments, seen well in FIGS. 1 and 2, the base (100) may have at least one base band peg (120) and the sled (500) may have at least one sled band peg (540), and in yet other embodiments, the at least one base band peg (120) and the at least one sled band peg (540) may be releasably connectable by at least one biasing means that increases a difficulty of moving the sled (500) from the cephalic aspect to the caudal aspect of the angulation slide (300). This allows a user (U) to increase his or her strength by exercising against resistance greater than that which would be supplied by the resistance of the sled and the user (U)'s body weight alone. One skilled in the art would visualize a large number of potential biasing means, but by way of example only and not limitation, biasing means including elastic bands and springs are specifically envisioned.

Referring now to FIGS. 2 and 3, in certain other embodiments, the base (100) may have at least one base plate (130). With reference to FIGS. 1-3, other embodiments may include those where the angulation slide (300) has at least one angulation slide handle (330) at the cephalic aspect of the angulation slide (300), and those wherein the user and angulation slide retainer (400) has a user and angulation slide retainer base plate (410) releasably engageable with the feet of a user (U) during operation of the device. Further derivations, as seen well in FIGS. 1 and 2, may be those where the user and angulation slide retainer (400) further includes at least one user retention means (420) releasably engageable with the legs of a user (U) during operation of the device. In some cases, the user retention means (420) may further include at least one roller (422) rotably mounted on a roller pivot (424) attached to the user retention means (420). Furthermore, the sled (500) may be provided with at least one user sled handle (530) grippable by a user (U) during operation of the device (10).

In another series of embodiments, with reference to FIGS. 1-3, there may be a hamstring exercise device (10) having a caudal aspect and a cephalic aspect. This device (10) may include a base (100), supporting a user and angulation slide retainer upright (405) at the caudal aspect and an angulation anchor (200) at the cephalic aspect. The angulation slide retainer upright (405) may be coupled to a user and angulation slide retainer (400), such that the angulation retainer upright (405) may be pivotably coupled to a caudal aspect of an angulation slide (300) by a angulation slide anchor retainer anchor (430) pivotably coupled to a angulation slide pivot (310).

Additionally, the angulation anchor (200) may be releasably coupled to a cephalic aspect of the angulation slide (300) at an angulation slide adjustment point (320) by at least one of a plurality of angulation adjustment points (210). The angulation slide (300) may be pivotably adjustable such as to produce a positive or negative incline, usually but not necessarily, a negative incline (declination) relative to the horizontal of the angulation slide (300), when the angulation slide adjustment point (320) is releasably coupled to at least one of the angulation adjustment points (210). This spatial arrangement is meant by way of example only and not limitation, and any spatial relationship between the angulation slide (300) and its supports (200, 400) is envisioned that allows for such a positive or negative incline (declination). In other embodiments, a sled (500) may be provided having a body support (510) that is slidably engaged to the angulation slide (300) at a sled slide (520) such that the sled (500) is slidably movable between the caudal and the cephalic aspects of the angulation slide (300).

In yet other embodiments, seen well in all Figures, the base (100) may have at least one base band peg (120) and the sled (500) may have at least one sled band peg (540), allowing for the possibility that the at least one base band peg (120) and the at least one sled band peg (540) may be releasably connectable by at least one biasing means that increases the difficulty of moving the sled (500) from the cephalic aspect to the caudal aspect of the angulation slide (300). As stated earlier, this allows a user (U) to increase his or her strength by exercising against resistance greater than that which would be supplied by the resistance of the sled and the user (U)'s body weight alone. One skilled in the art would visualize a large number of potential biasing means, but by way of example only and not limitation, biasing means including elastic bands and springs are specifically envisioned.

In terms of a user (U)'s operation of the device (10), and with particular reference to FIGS. 1 and 2, the user and angulation slide retainer (400) may have a user and angulation slide retainer base plate (410) that is releasable engageable with the feet of a user (U) during operation of the device. As well, the user and angulation slide retainer (400) may further include at least one user retention means (420) that is releasably engageable with the legs of a user (U) during operation of the device.

In yet another series of embodiments, a hamstring exercise device (10) may be provided having a caudal aspect and a cephalic aspect, that further includes a base (100), supporting a user and angulation slide retainer upright (405) at the caudal aspect and an angulation anchor (200) at the cephalic aspect. The angulation slide retainer upright (405) may be coupled to a user and angulation slide retainer (400), such that the angulation retainer upright (405) is pivotably coupled to a caudal aspect of an angulation slide (300) by an angulation slide anchor retainer anchor (430) pivotably coupled to a angulation slide pivot (310). The angulation anchor (200) may be releasably coupled to a cephalic aspect of the angulation slide (300) at an angulation slide adjustment point (320) by at least one of a plurality of angulation adjustment points (210), such that the angulation slide (300) may produce a positive or negative incline, usually but not necessarily a negative incline (declination) relative to the horizontal of the angulation slide (300) when the angulation slide adjustment point (320) is releasably coupled to at least one of the angulation adjustment points (210). In some embodiments, the plurality of angulation adjustment points (210) may be approximately equally spaced in a superior-inferior aspect along the angulation anchor (200). This spatial arrangement is meant by way of example only and not limitation, and any spatial relationship between the angulation slide (300) and its supports (200, 400) is envisioned that allows for a positive or negative incline (declination) of the angulation slide (300). However, it has been found that a useful arrangement allows the angulation slide (300) to be pivotably adjustable between any two adjoining angulation adjustment points (210) such as to produce a positive or negative inclination (declination) of the angulation slide (300) increasing by approximately 6.5 degrees relative to the horizontal when the angulation slide adjustment point (320) is moved from a superior angulation adjustment point (210) to an adjacent inferior angulation adjustment point (210), or vice versa. In other embodiments, a sled (500) may be provided having a body support (510) that may be slidably engaged to the angulation slide (300) at a sled slide (520), such that the sled (500) is slidably movable between the caudal and the cephalic aspects of the angulation slide (300).

In yet other embodiments, the base (100) may have at least one base band peg (120) and the sled (500) may have at least one sled band peg (540). The at least one base band peg (120) and the at least one sled band peg (540) may be releasably connectable by at least one biasing means that increases a difficulty of moving the sled (500) from the cephalic aspect to the caudal aspect of the angulation slide (300). This, again, allows a user (U) to increase his or her strength by exercising against resistance greater than that which would be supplied by the resistance of the sled and the user (U)'s body weight alone. One skilled in the art would visualize a large number of potential biasing means, but by way of example only and not limitation, biasing means including elastic bands and springs are specifically envisioned.

In terms of a user (U)'s operation of the device (10), and with particular reference to FIGS. 1 and 2, the user and angulation slide retainer (400) may have a user and angulation slide retainer base plate (410) that is releasably engageable with the feet of a user (U) during operation of the device. As well, the user and angulation slide retainer (400) may further include at least one user retention means (420) releasably engageable with the legs of a user (U) during operation of the device.

One skilled in the art will immediately see a method of using the device. A user may first adjust the positive or negative inclination (declination) of the angulation slide (300) by means of selecting an appropriate angulation adjustment point (210) and then adjusting the angulation slide adjustment point (320) to the corresponding angulation adjustment point (210). Optionally, and in some embodiments only, a user (U) may employ or adjust a biasing means between the base band peg (120) and the sled band peg (540), to increase an exercise's intensity.

Next, a user (U) would mount the machine, such that the general hip area of the user (U) would be supported on the sled (500), and the user (U) would engage the feet on the user and angulation slide retainer (400), commonly but not necessarily by engaging the feet in the user retention means (420). The user (U) then may allow body flexion and extension to move the sled between a relatively more caudal and relatively more cephalic position on the device (10). It can be readily seen that the user (U)'s body weight, the resistance provided by the sled (500) moving on the angulation slide (300), and the effect of any biasing means provided, gives resistance to exercise.

Numerous alterations, modifications, and variations of the preferred embodiments disclosed herein will be apparent to those skilled in the art and they are all anticipated and contemplated to be within the spirit and scope of the disclosed specification. For example, although specific embodiments have been described in detail, those with skill in the art will understand that the preceding embodiments and variations can be modified to incorporate various types of substitute and or additional or alternative materials, relative arrangement of elements, order of steps and additional steps, and dimensional configurations. Accordingly, even though only few variations of the device and method are described herein, it is to be understood that the practice of such additional modifications and variations and the equivalents thereof, are within the spirit and scope of the method and products as defined in the following claims. The corresponding structures, materials, acts, and equivalents of all means or step plus function elements in the claims below are intended to include any structure, material, or acts for performing the functions in combination with other claimed elements as specifically claimed.

I claim:

1. A hamstring exercise device (10) having a caudal aspect and a cephalic aspect, comprising:

a fixed base (100), for supporting a user and fixedly joining an angulation slide retainer upright (405) at the caudal aspect and an angulation anchor (200) at the cephalic aspect, the angulation slide retainer upright (405) being releasably coupleable to a user and fixedly couplable to an angulation slide retainer (400), the angulation slide retainer upright (405) being pivotably coupled to a caudal aspect of an angulation slide (300) by an angulation slide anchor retainer anchor (430) pivotably coupled to an angulation slide pivot (310), the angulation anchor (200) being releasably coupled to a cephalic aspect of the angulation slide (300) by an angulation adjustment point (210) releasably coupled to an angulation slide adjustment point (320), wherein the angulation adjustment point (210) is a plurality of vertically disposed adjacent angulation adjustment points (210) arranged in a superior-inferior orientation, and the angulation slide (300) is pivotably adjustable to said points (210) such as to produce a cephalic lowered, or no incline relative to the horizontal, of the angulation slide (300) when the angulation slide adjustment point (320) is releasably coupled to at least one of the cephalic angulation adjustment points (210), and a sled (500) having a body support (510) being slidably engaged to the angulation slide (300) at a sled slide (520) wherein the sled (500) is slidably movable between the caudal and the cephalic aspects of the angulation slide (300).

2. The device according to claim 1, wherein the plurality of adjacent angulation adjustment points (210) are approximately equally spaced in a vertically disposed superior-inferior aspect along the angulation anchor (200), and the angulation slide (300) is pivotably adjustable between any two adjoining angulation adjustment points (210) such as to produce a declination of the angulation slide (300) increasing by approximately 6.5 degrees relative to the horizontal when the angulation slide adjustment point (320) is moved from a superior angulation adjustment point (210) to an adjacent inferior angulation adjustment point (210).

3. The device according to claim 1, wherein the base (100) has at least one fixed base leg (110) at each of the caudal and cephalic aspect of the angulation slide (300) and wherein at least one of the caudal aspect and one of the cephalic aspect base legs (110) are fixedly connected.

4. The device according to claim 1, wherein the base (100) has at least one base band peg (120) and the sled (500) has at least one sled band peg (540), and the at least one base band peg (120) and the at least one sled band peg (540) are releasably connectable to each other by at least one biasing means that increases a difficulty of moving the sled (500) from the cephalic aspect to the caudal aspect of the) angulation slide (300).

5. The device according to claim 4, wherein the biasing means is selected from the group of biasing means consisting of elastic bands and springs.

6. The device according to claim 1, wherein the base (100) has at least one base plate (130), having a horizontal surface spanning a full range of motion of the angulation slide (300), and spanning at least a full width of the angulation slide (300).

7. The device according to claim 1, wherein the angulation slide (300) has at least one angulation slide handle (330) fixedly attached at the cephalic aspect of the angulation slide (300).

8. The device according to claim 1, wherein the angulation slide retainer (400) has a user and angulation slide retainer base plate (410) releasably engageable with the feet of a user during operation of the device.

9. The device according to claim 1, wherein the angulation slide retainer (400) further comprises at least one user retention means (420) releasably engageable with the legs of a user during operation of the device.

10. The device according to claim 9, wherein the user retention means (420) further comprises at least one roller (422) rotatably mounted on a roller pivot (424) attached to the user retention means (420).

11. The device according to claim 1, wherein the sled (500) has at least one user sled handle (530) rigidly attached to the sled (500) and grippable by a user during operation of the device (10).

12. A hamstring exercise device (10) having a caudal aspect and a cephalic aspect, comprising:

a fixed base (100), for supporting a user and fixedly joining an angulation slide retainer upright (405) at the caudal aspect and an angulation anchor (200) at the cephalic aspect;

the angulation slide retainer upright (405) being releasably coupleable to a user and fixedly coupled to an angulation slide retainer (400), the angulation slide retainer upright (405) being pivotably coupled to a caudal aspect of an angulation slide (300) by an angulation slide anchor retainer anchor (430) pivotably coupled to an angulation slide pivot (310), the angulation anchor (200) being releasably coupled to a cephalic aspect of the angulation slide (300) at an angulation slide adjustment point (320) by at least one of a plurality of angulation adjustment points (210), and the angulation slide (300) being pivotably adjustable such as to produce a cephalic-lowered declination relative to the horizontal of the angulation slide (300) when the angulation slide adjustment point (320) is releasably coupled to at least one of the angulation adjustment points (210), and a sled (500) having a body support (510) being slidably engaged to the angulation slide (300) at a sled slide (520) wherein the sled (500) is slidably movable between the caudal and the cephalic aspects of the angulation slide (300).

13. The device according to claim 12, wherein the base (100) has at least one base band peg (120) and the sled (500) has at least one sled band peg (540), and the at least one base band peg (120) and the at least one sled band peg (540) are releasably connectable by at least one biasing means that increases a difficulty of moving the sled (500) from the cephalic aspect to the caudal aspect of the angulation slide (300).

14. The device according to claim 12, wherein the angulation slide retainer (400) has a user and angulation slide retainer base plate (410) fixedly attached to the angulation slide retainer (400) and releasably engageable with the feet of a user during operation of the device.

15. The device according to claim 12, wherein the user and angulation slide retainer (400) further comprises at least one user retention means (420) releasably engageable with the legs of a user during operation of the device.

16. A hamstring exercise device (10) having a caudal aspect and a cephalic aspect, comprising:

a fixed base (100), for supporting a user and fixedly joining an angulation slide retainer upright (405) at the caudal aspect and an angulation anchor (200) at the cephalic aspect;

the angulation slide retainer upright (405) being coupleable to a user and to an angulation slide retainer (400), wherein the angulation slide retainer upright (405) being pivotably coupled to a caudal aspect of an angulation slide (300) by an angulation slide anchor retainer anchor (430) pivotably coupled to an angulation slide pivot (310), the angulation anchor (200) being releasably coupled to a cephalic aspect of the angulation slide (300) at an angulation slide adjustment point (320) by at least one of a plurality of angulation adjustment points (210), and the angulation slide (300) is pivotably adjustable such as to produce a declination relative to the horizontal of the angulation slide (300) when the angulation slide adjustment point (320) is releasably coupled to at least one of the angulation adjustment points (210), wherein the plurality of angulation adjustment points (210) are approximately equally spaced in a superior-inferior aspect along the angulation anchor (200), and the angulation slide (300) is pivotably adjustable between any two adjoining angulation adjustment points (210) such as to produce a cephalic-lowered declination of the angulation slide (300) increasing by approximately 6.5 degrees relative to the horizontal when the angulation slide adjustment point (320) is moved from a superior angulation adjustment point (210) to an adjacent inferior angulation adjustment point (210), and a sled (500) having a body support (510) being slidably engaged to the angulation slide (300) at a sled slide (520) wherein the sled (500) is slidably movable between the caudal and the cephalic aspects of the angulation slide (300).

17. The device according to claim 16, wherein the base (100) has at least one base band peg (120) and the sled (500) has at least one sled band peg (540), and the at least one base band peg (120) and the at least one sled band peg (540) are releasably connectable by at least one biasing means that increases a difficulty of moving the sled (500) from the cephalic aspect to the caudal aspect of the angulation slide (300).

18. The device according to claim 16, wherein the angulation slide retainer (400) further comprises at least one user retention means (420) releasably engageable with the legs of a user during operation of the device.

* * * * *